US005517975A

United States Patent [19]

Iwata

[11] Patent Number: 5,517,975

[45] Date of Patent: May 21, 1996

[54] FUEL PURIFYING DEVICE FOR USE IN AN INTERNAL COMBUSTION ENGINE

[75] Inventor: Yosihiro Iwata, 809-2, Higashiirushuzei-cho Sagaru Nijyo Senbondori, Kamigyo-ku, Kyoto-shi, 602, Japan

[73] Assignee: Yosihiro Iwata, Kyoto, Japan

[21] Appl. No.: 405,594

[22] Filed: Mar. 17, 1995

[30] Foreign Application Priority Data

Nov. 22, 1994 [JP] Japan ..... 6-311313

[51] Int. Cl.[6] ..... F02M 27/04

[52] U.S. Cl. ..... 123/538; 422/186.01

[58] Field of Search ..... 123/536, 537, 123/538, 25 R; 210/695, 222; 422/186.01; 204/155.15

[56] References Cited

U.S. PATENT DOCUMENTS

| | | | |
|---|---|---|---|
| 3,976,726 | 8/1976 | Johnson | 123/536 |
| 4,069,665 | 1/1978 | Bolasny | 123/538 |
| 4,326,954 | 4/1982 | Shroyer | 123/538 |
| 4,865,747 | 9/1989 | Larson et al. | 210/695 |
| 4,933,151 | 6/1990 | Sung | 422/186.01 |
| 5,092,303 | 3/1992 | Brown | 123/538 |
| 5,236,670 | 8/1993 | Iwata . | |
| 5,320,726 | 6/1994 | Iwata | 204/157.15 |
| 5,377,648 | 1/1995 | Iwata . | |

FOREIGN PATENT DOCUMENTS 6-167254 6/1994 Japan .

*Primary Examiner*—Marguerite Macy
*Attorney, Agent, or Firm*—Flynn, Thiel, Boutell & Tanis

[57] ABSTRACT

There is provided a purifying device capable of purifying fuel having less impurities and many dissolved oxygen by applying a low frequency/voltage/current signal to the fuel during supply of fuel at the portion in front of and behind a fuel filter. The purifying device for use in an internal combustion engine comprises a fuel supply pipe for use in an internal combustion engine, wherein the fuel supply pipe is connected to a fuel tank and has a fuel supply pump, a fuel injection pump and a fuel filter between the fuel supply pump and the fuel injection pump respectively disposed thereon, a fuel flowing pipe made of synthetic resin to which the fuel supply pipe is connected, a conductive coil wound around an outer periphery of the fuel flowing pipe, or arc-shaped conductive plates which are provided in confronting relation with each other along an outer periphery of the fuel flowing pipe, a protection cover for covering an outer periphery of the conductive coil or arc-shaped conductive plates, an ac signal generator connected to a battery for generating a low frequency/voltage/current signal and applying the signal to the conductive coil or arc-shaped conductive plates, wherein the purifying device is disposed between the fuel supply pump and the fuel filter and another purifying device is disposed between the fuel injection pump and the fuel filter.

20 Claims, 3 Drawing Sheets

FUEL PURIFYING DEVICE FOR USE IN AN INTERNAL COMBUSTION ENGINE

BACKGROUND OF THE INVENTION

1. Field of the Invention

The present invention relates to a fuel purifying device for use in an internal combustion engine to improve the combustion of gasoline, light oil or heavy oil used in an engine of an automobile, etc. and to purify exhausted gas.

2. Prior Art

There have been known a device for purifying fuel which is proposed by the inventor of this application and disclosed in Japanese Patent Laid-Open Publication No. 6-167254 (and corresponding U.S. Pat. No. 5,236,670) and which comprises a fuel supply pipe for use in an internal combustion engine, a fuel flowing pipe made of synthetic resin to which the fuel supply pipe is connected, a conductive coil wound around an outer periphery of the fuel flowing pipe, a protection cover for covering an outer periphery of the conductive coil. This device also has an ac signal generator connected to a battery for generating a low frequency/voltage/current signal and applying the signal to the conductive coil.

There has been also known a device for purifying fuel which is proposed by the inventor of this application and disclosed in Japanese Patent Application No. 5-257504 (and corresponding U.S. Pat. No. 5,377,648). This device comprises a fuel supply pipe for use in an internal combustion engine, a fuel flowing pipe made of synthetic resin to which the fuel supply pipe is connected, arc-shaped conductive plates which are provided in confronting relation with each other along an outer periphery of the fuel flowing pipe, a protection cover covering the outer peripheries of the conductive plates. This device also has an ac signal generator connected to a battery for generating a low frequency/voltage/current signal and applying the signal to the arc-shaped conductive plates.

However, there is little discussion of the location of the fuel purifying device in these publications, namely, a detailed location where the fuel purifying device is located on the fuel supply pipe in the aforementioned conventional devices. If the fuel purifying device is disposed only between a fuel supply pump and a fuel filter, dissolved oxygen in the fuel is increased by applying a low frequency/voltage/current signal from the fuel purifying device. However, when the dissolved oxygen reacts with metallic impurities in the fuel, colloidal cores are generated. These colloidal cores gradually and finally are caught by a fuel filter. As a result, the dissolved oxygen in the fuel is scarcely increased, which is insufficient for the improvement of the fuel.

On the other hand, if the fuel purifying device is disposed only between the fuel filter and a fuel injection pump, the dissolved oxygen in the fuel is increased by applying a low frequency/voltage/current signal from the fuel purifying device. However, the dissolved oxygen reacts on metallic impurities which are not caught by the filter, colloidal cores are generated and are is sent to an engine as it is grown up gradually, which causes incomplete combustion. As a result, an exhaust gas is polluted and the dissolved oxygen in the fuel is not so increased.

SUMMARY OF THE INVENTION

The present invention has been made in view of the aforementioned problems of the prior art. It is an object of the invention to provide a purifying device that enables the fuel to have less impurities and increased oxygen content by applying a low frequency/voltage/current signal to the fuel stream both in front of and behind the fuel filter.

To achieve the above object, the purifying device for use in an internal combustion engine comprises a fuel supply pipe for use in an internal combustion engine, that is connected to a fuel tank and that has a fuel supply pump, a fuel injection pump and a fuel filter between the fuel supply pump and the fuel injection pump. The device further comprises fuel communication pipes made of synthetic resin to which the fuel supply pipe is connected. Conductive coils are wound around an outer periphery of the fuel flowing pipe, or arc-shaped conductive plates which are provided in confronting relation with each other along an outer periphery of the fuel flowing pipe. A protection cover is provided for covering an outer periphery of the conductive coil or outer peripheries of the arc-shaped conductive plates. An AC signal generator is connected to a battery for generating a low frequency/voltage/current signal and applying the signal to the conductive coil, wherein the purifying device is disposed between the fuel supply pump and the fuel filter and another purifying device is disposed between the fuel injection pump and the fuel filter.

In case of using the conductive coils, the ac signal generator generates low frequency ranging from 30 Hz to 130 Hz, low voltage ranging from 0.05 V to 1.5 V and low current ranging from 250 mA to 3.0 mA. In case of using the arc-shaped conductive plates, the ac signal generator generates low frequency ranging from 30 Hz to 130 Hz, low voltage ranging from 1 V to 3 V and low current ranging from 800 mA to 3.0 mA.

With the arrangement of the purifying device for use in an internal combustion engine according to the present invention, when electrostatic induction fields caused by low frequency/voltage/current signals from the conductive coil act upon the fuel, fuel molecules are varied so that the dissolved oxygen is increased. Consequently, impurities in the fuel are made colloidal in the portion of the device positioned in front of the fuel filter so as to effectively catch the colloidal impurities by the fuel filter. Then, the dissolved oxygen in the fuel having less impurities is increased in the fuel purifying device behind the fuel filter. As a result, combustion of fuel in the engine is more complete and also nitrogen oxides (hereinafter referred to as NOx), carbon monoxide (hereinafter referred to as CO), hydrocarbons (hereinafter referred to as HC), or the like contained in the exhaust gas are remarkably reduced. The electrostatic induction fields caused by the low frequency/voltage/current signals from the conductive coil or arc-shaped conductive plates act upon the fuel two times, first in front of the fuel filter and secondly behind the fuel filter, so that the electrostatic induction fields concentrically and uniformly act upon the fuel to be supplied from the fuel tank to the engine, thereby easily improving the quality of fuel.

PREFERRED EMBODIMENT OF THE INVENTION

Figure 1:
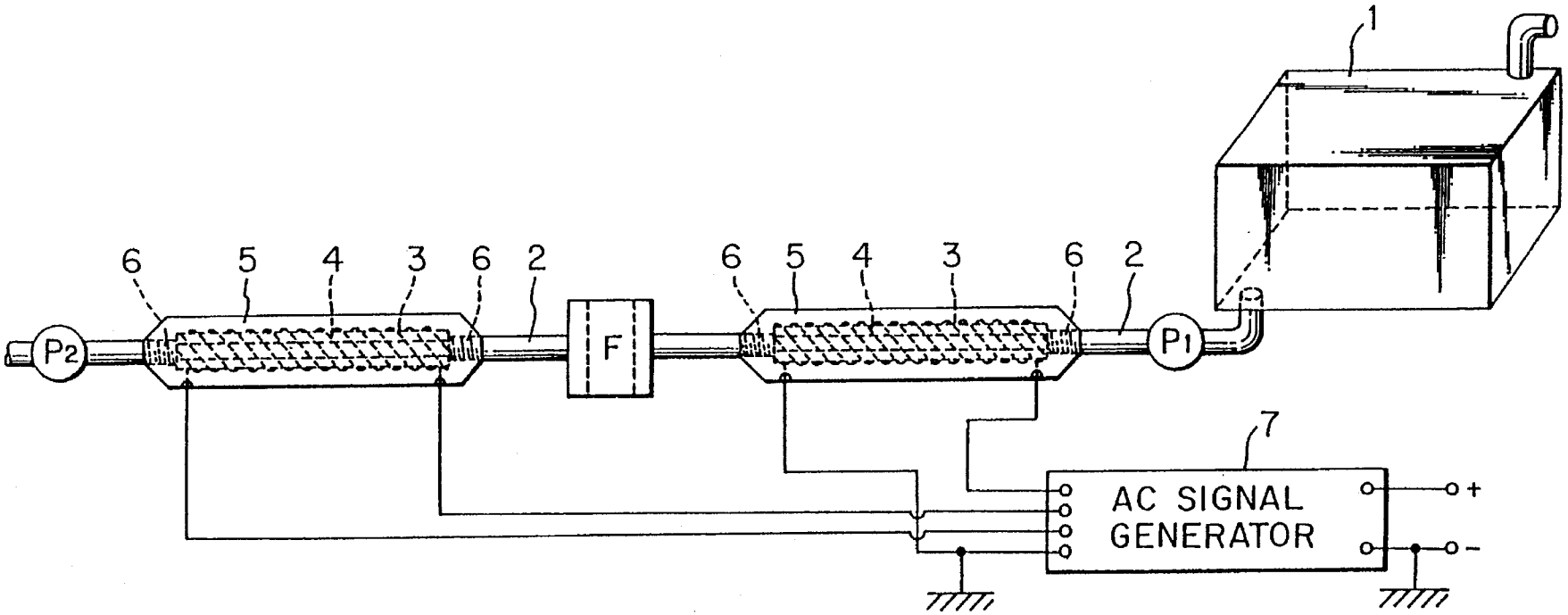
FIG. 1 is a view showing an arrangement of a fuel purifying device according to a first embodiment of the invention.
Figure 2:
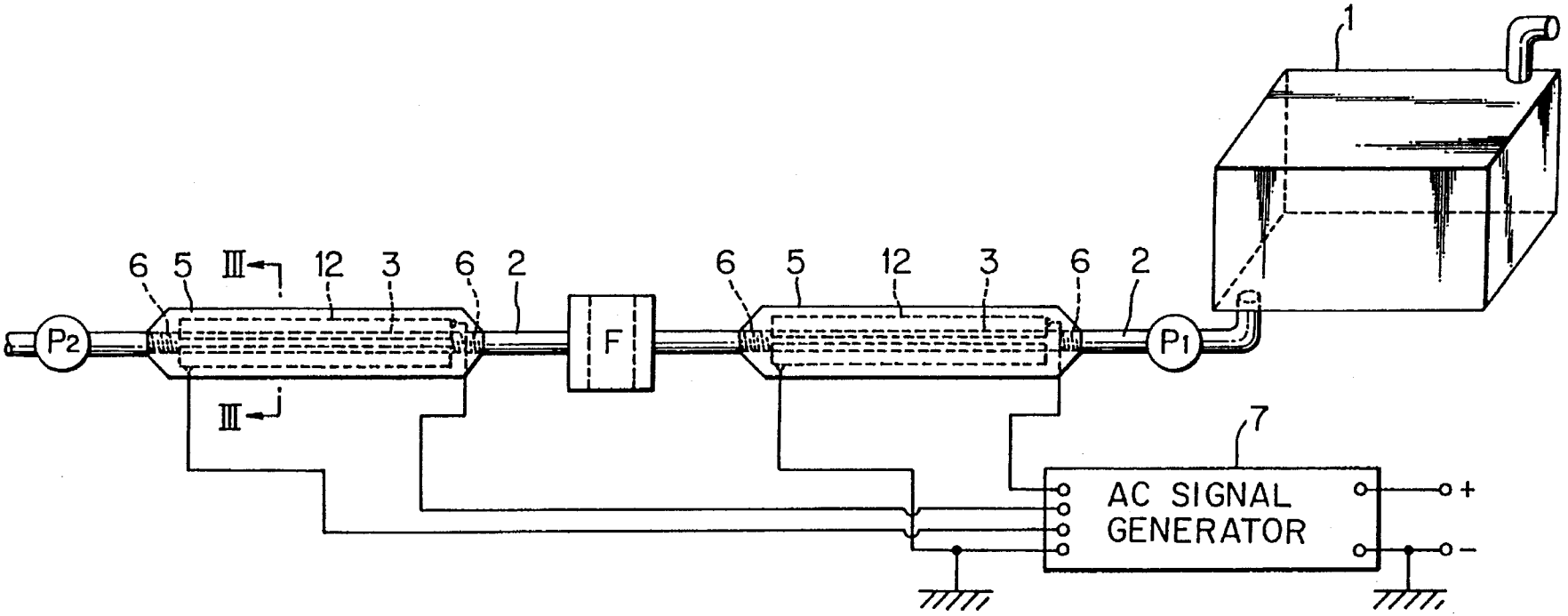
FIG. 2 is a view showing an arrangement of a fuel purifying device according to a second embodiment of the invention.
Figure 3:
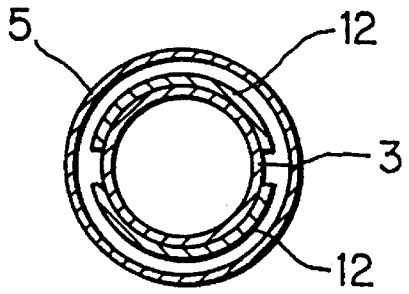
FIG. 3 is a cross-sectional view taken along III—III of FIG. 2.

A purifying device for use in an internal combustion engine according to a first embodiment will be described with reference to FIGS. 1 and 4.

In the same figures, denoted at 1 is a fuel tank 1 mounted on an automobile. A fuel supply pipe 2 is disposed between the fuel tank 1 and an engine, not shown, and a fuel flowing or communication, pipe 3 formed of synthetic resin is disposed at any portion of the fuel supply pipe 2. A first fuel flowing pipe 3 is connected between a fuel supply pump P1 and a fuel filter F and a second fuel flowing pipe 3 is connected between a fuel injection pump P2 and the fuel filter F.

A conductive coil 4 is wound around the outer periphery of each fuel flowing pipe 3 and it is covered with a protection cover 5 so that they are prevented from being slipped off or broken even if vibrated. Screws 6 and 6 are formed on both ends of each fuel flowing pipe 3 and the fuel flowing pipes 3 are connected to the fuel supply pipe 2 by these screws 6.

Denoted at 7 is an ac signal generator 7 which is connected to plus and minus terminals of a battery mounted on the automobile. Output terminals of the ac signal generator 7 are connected to the conductive coils 4.

Figure 4:
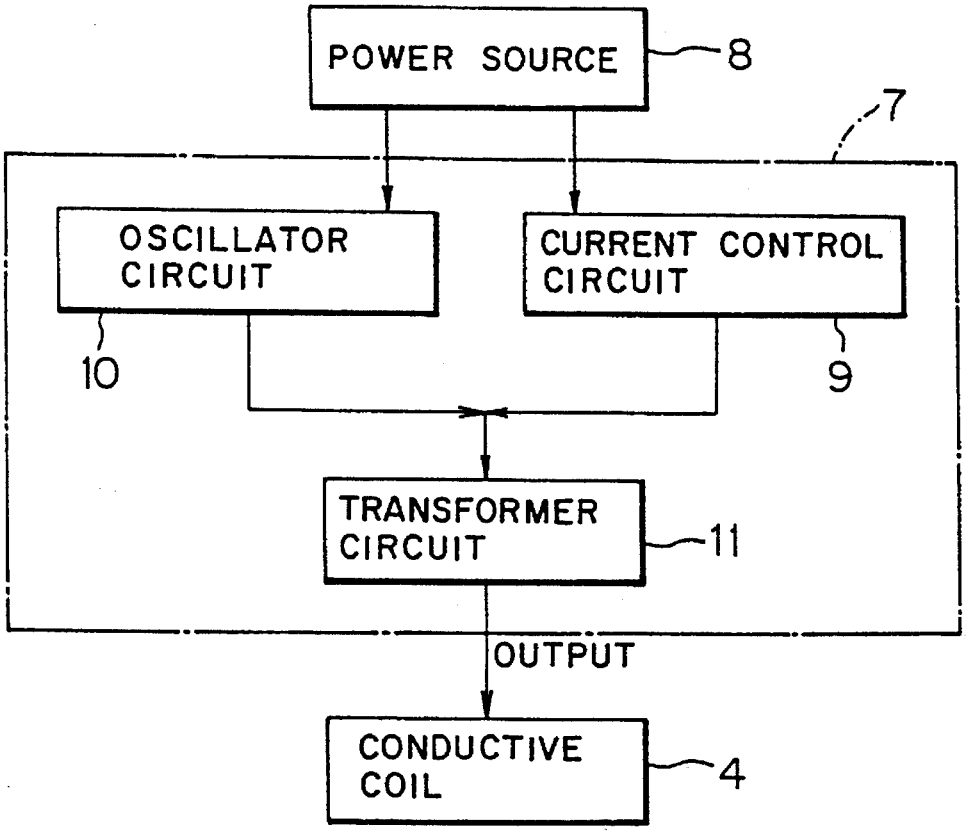
FIG. 4 is a schematic view of an ac signal generator.

FIG. 4 is a schematic view showing the arrangement of the connection between the ac signal generator 7 and a conductive coil 4. A current from a power source 8 such as a battery, etc. is selectively controlled within a range of 250 mA to 3.0 μA by a current control circuit 9 of the ac signal generator 7 depending on a kind of fuel. A low frequency ranging from 30 to 130 Hz is generated by an oscillator circuit 10. A transformer circuit 11 can selectively supply voltage to the conductive coil 4 within a range of 0.05 to 1.5 V.

The values of the frequency, current and voltage vary depending on the kind of fuel. The following effects are proved as a result of test. In case of heavy oil or light oil, it is preferable that the ac signal generator 7 selects the frequency ranging from 100 to 130 Hz, voltage ranging from 0.05 to 1 V and current ranging from 250 μA to 1.0 mA so to both reduce the generation of NOx and increase the amount of the dissolved oxygen is relatively reduced. In case of gasoline, it is preferable that the ac signal generator 7 selects the frequency ranging from 30 to 60 Hz, voltage ranging from 0.05 to 1.5 V and current ranging from 250 μA to 3.0 mA to both reduce the amount of CO generated so that the amount of dissolved oxygen is relatively increased.

In the purifying device having the arrangement as set forth above, when electrostatic induction fields caused by low frequency/voltage/current signals from each conductive coil 4 act upon the fuel, molecules in the fuel are varied, broken up, so that the dissolved oxygen in fuel is increased. In the portion of the purifying device which is disposed between the fuel supply pump P1 and fuel filter F, impurities in the fuel are made colloidal and are effectively caught by the fuel filter F. In the purifying device between the portion of the fuel filter F and the fuel injection pump P2, the dissolved oxygen in the reduced-impurities fuel is increased so that the fuel is completely combusted in the engine, not shown, disposed downstream from the fuel injection pump P2. Moreover, NOx, CO, HC, or the like which is contained in the exhaust gas are remarkably reduced. Since the processing of the fuel is performed in front of and behind the fuel filter F between the fuel tank I and the engine, the electrostatic induction fields uniformly and concentrically act upon the fuel supplied from the fuel tank to the engine, thereby improving the quality of fuel.

In a purifying device according to a second embodiment of the invention, the conductive coils 4 in the first embodiment are replaced by arc-shaped conductive plates 12 to which the low frequency/voltage/current signal are applied. Other elements of the second embodiment are the same as those of the first embodiment, and hence they are denoted at the same numerals and the explanation thereof is omitted.

The arc-shaped conductive plates 12 are provided in opposed relation with each other along an outer periphery of the fuel flowing pipe 3 and each of the arc-shaped conductive plates 12 is covered with the protection cover 5 so that it is prevented from being slipped off or broken even it is vibrated. Screws 6 are provided on both ends of the fuel flowing pipes 3 and the fuel flowing pipes 3 are connected to the fuel supply pipe 2 by these screws 6.

Denoted at 7 is the ac signal generator 7 which is connected to the plus and minus terminals of the battery mounted on the automobile and the output terminals of the ac signal generator 7 are connected to the arc-shaped conductive plates 12. That is, the arc-shaped conductive plates 12 are provided instead of the conductive coil 4 in FIG. 4. A current from the power source 8 such as the battery, etc. is selectively controlled within a range of 800 μA to 3.0 mA by the current control circuit 9 of the ac signal generator 7 depending on a kind of fuel. A low frequency signal ranging from 30 to 130 Hz is generated by the oscillator circuit 10. The transformer circuit 11 can selectively supply a voltage to the arc-shaped conductive plates 12 within a range of 1 to 3 V.

Numerical values of the frequency, current and voltage vary depending on the kind of fuel. The following effects are proved as a result of test. In case of heavy oil or light oil, it is preferable that the ac signal generator 7 selects the frequency ranging from 100 to 130 Hz, voltage ranging from 1 to 2.5 V and current ranging from 800 μA to 1.5 mA so as to reduce the amount of NOx generated so that the amount of the dissolved oxygen is relatively reduced. In case of gasoline, it is preferable that the ac signal generator 7 selects the frequency ranging from 30 to 60 Hz, voltage ranging from 1 to 3 V and current ranging from 800 mA to 3.0 μA so as to reduce the amount of CO to be generated so that the amount of the dissolved oxygen is relatively increased. Numerical values of current and voltage applied to the arc-shaped conductive plates 12 are slightly greater than those to be applied to the conductive coil 4 because the loss of current and voltage in the arc-shaped conductive plates 12 is slightly greater than that in the conductive coils 4.

Since the arc-shaped conductive plates 12 always form constant electrostatic induction fields therebetween by their electrodes, if a part of the fuel flowing from the fuel tank 1 to the engine reaches the area subtended by the opposed plates 12, the fuel is surely purified due to the operation of the electrostatic induction fields, even if the amount of fuel to be supplied is small.

In the second embodiment, the arc-shaped conductive plates 12 are disposed around the outer periphery of the fuel flowing pipe 3 as a single pair but plural pairs of the arc-shaped conductive plates 12 may be disposed around the outer periphery of the fuel flowing pipe 3. In this case, the low frequency/voltage/current signal may be applied to such plural sets of arc-shaped conductive plates 12 by varying the numerical values of frequency, voltage and current within the aforementioned ranges.

With the arrangement of the purifying device for use in an internal combustion engine according to the present invention, when electrostatic induction fields caused by low frequency/voltage/current signals from the arc-shaped conductive plates 12 act upon the fuel, the fuel molecules are varied, broke apart, so that the dissolved oxygen in the fuel stream is increased. Impurities in the fuel are made colloidal in the portion of the fuel purifying device positioned behind the fuel supply pump P1 and in front of the fuel filter F. Consequently, these colloidal impurities are effectively caught by the fuel filter. The dissolved oxygen in the fuel, from which the impurities have been removed, is increased in the portion of the fuel purifying device behind the fuel filter and in front of the fuel injection pump 2 so that the fuel is completely combusted in the engine disposed downline of the fuel injection pump P2. Also NOx, CO, HC, or the like contained in the exhaust gas is remarkably reduced. The electrostatic induction fields caused by low frequency/voltage/current signals from the conductive coils or the arc-shaped conductive plates act upon the fuel two times, firstly in front of the fuel filter and secondly behind the fuel filter, so that the electrostatic induction fields concentrically and uniformly act upon the fuel supplied from the fuel tank to the engine, thereby improving the quality of fuel.

With the arrangement of the purifying device for use in the internal combustion engine according to the present invention, when electrostatic induction fields caused by low frequency/voltage/current signals from the conductive coil or arc-shaped conductive plates 12 act upon the fuel, the fuel molecules are varied, broken up, so that the dissolved oxygen content of the fuel is increased. As a result, NOx, CO, HC, or the like which is contained in the exhausted gas can be remarkably reduced, which is very convenient anti-pollution measure. Furthermore, the purifying device is safe and manufactured at low cost since it utilizes the low voltage.

Since the aforementioned processing is performed in front of and behind the fuel filter, there are following effects. That is, in the purifying device which is disposed between the fuel supply pump P1 and fuel filter F, impurities in the fuel are made colloidal and such colloidal impurities are effectively caught by the fuel filter F. In the purifying device between the fuel filter F and the fuel injection pump P2, the dissolved oxygen in the fuel, impurities of which are reduced, is increased so that the fuel is completely combusted in the engine, not shown, disposed at the rear portion of the fuel injection pump P2 and NOx, CO, HC, or the like which is contained in the exhaust gas are remarkably reduced, so that the electrostatic induction fields concentrically and uniformly act upon the fuel to be supplied from the fuel tank to the engine, thereby easily improving the quality of fuel.

What is claimed is:

1. An assembly for purifying fuel as it travels in a fuel stream from a vehicle fuel tank to a vehicle engine, said assembly comprising:

a fuel supply pipe disposed between the fuel tank and the engine, said fuel supply pipe serving as a conduit through which the fuel stream travels;

first and second spaced apart fuel communication pipes coupled to said fuel supply pipe so as to serially receive the fuel stream, said first fuel communication pipe being located proximately toward the vehicle fuel tank, said second fuel communication pipe being located proximately toward the vehicle engine;

a conductive element disposed around each said fuel communication pipe, said conductive elements being configured so that when a signal is applied thereto, said signals cause electrostatic induction fields to develop across said fuel communication pipes and portions of the fuel stream in said fuel communication pipes;

an AC signal generator connected to said conductive elements to apply AC signals thereto, said signals being sufficient in frequency, voltage and current to cause an increase in the dissolved oxygen in the fuel stream portions located in said communication pipes so that in said first communication pipe, impurities in the fuel stream bond with the dissolved oxygen to form colloidal masses; and a fuel filter disposed between said first and second communication pipes and in fluid connection with said communication pipes, said filter being configured to remove the colloidal masses from the fuel stream prior to the fuel stream flowing into said second fuel communication pipe.

2. The fuel purifying assembly of claim 1, wherein said AC generator applies signals to said conductive elements, said signals having a frequency between 30 Hz to 130 Hz, a voltage between 0.05 V to 3.0 V and a current between 250 μA and 3.0 mA.

3. The fuel purifying assembly of claim 1, further including protective covers disposed around said conductive elements.

4. The fuel purifying assembly of claim 1, wherein said AC signal generator is configured to apply the same signal to both said conductive elements.

5. The fuel purifying assembly of claim 4, wherein said AC generator applies a signal to said conductive elements having a frequency between 30 Hz to 130 Hz, a voltage between 0.05 V to 1.5 V and a current between 250 μA and 3.0 mA.

6. The fuel purifying assembly of claim 1, wherein at least one said conductive element is a conductive coil wound around said fuel communication pipe with which said conductive element is associated.

7. The fuel purifying assembly of claim 6, wherein said AC signal generator is configured to apply a signal to said at least one conductive coil having a voltage between 0.05 V to 1.5 V and a current between 250 μA and 3.0 mA.

8. The fuel purifying assembly of claim 6, wherein both said conductive elements are conductive coils and said AC signal generator is configured to supply the same signal to both said conductive coils.

9. The fuel purifying assembly of claim 1, wherein at least one said conductive element comprises at least one pair of diametrically opposed conductive plates disposed around said fuel communication pipes with which said conductive element is associated.

10. The fuel purifying assembly of claim 9, wherein said AC signal generator is configured to apply a signal across said conductive plates having a voltage between 1 V to 3 V and a current between 800 μA and 3.0 mA.

11. The fuel purifying assembly of claim 9, wherein both said conductive elements comprise at least one pair of opposed conductive plates and said signal generator is configured to apply the same signal to both said pairs of conductive plates.

12. The fuel purifying assembly of claim 9, wherein said at least one pair of conductive plates is from two arcuate shaped plates.

13. The fuel purifying assembly of claim 1, further including a fuel injection pump connected to receive the fuel stream upon discharge from said second fuel communication pipe and to pump the fuel into the vehicle engine.

14. A method of purifying fuel in a fuel stream as it flows from a fuel tank to a vehicle engine, the fuel including metallic impurities, said method including the steps of:

pumping the fuel from the fuel tank to the vehicle engine so as to form the fuel stream;

imposing a first electrostatic induction field across the fuel stream so as to cause molecules forming the fuel to break up and the dissolved oxygen content in the fuel stream to increase, which in turn causes the impurities in the fuel stream to form colloidal masses with the dissolved oxygen;

filtering the fuel stream so as to remove the colloidal impurity masses generated in response to the application of said first electrostatic induction field;

applying a second electrostatic induction field across the fuel stream after said filtering step so as to cause said fuel molecules to break up and the dissolved oxygen content fuel to increase; and supplying the fuel to the vehicle engine after said second electrostatic induction field is applied thereto.

15. The method of fuel purification of claim 14, wherein signals used to apply said first and second electrostatic induction fields are AC signals having a frequency between 30 and 130 Hz, a voltage between 0.05 to 3 V and a current between 250 μA and 3.0 mA.

16. The method of purifying fuel of claim 14, wherein a single signal having common frequency, voltage and current characteristics is applied to said fuel stream so as to cause a generation of both said first and said second electrostatic induction fields.

17. The method of purifying fuel of claim 16, wherein said signal applied to the fuel stream so as to cause said first and said second electrostatic induction fields to develop has a frequency between 30 and 130 Hz, a voltage between 0.05 to 3 V and a current between 250 μA and 3.0 mA.

18. The method of purifying fuel of claim 14, wherein fuel is pumped from the fuel tank to the vehicle engine through first and second serially arranged fuel communication pipes, first and second conductive coils are respectively disposed around said first and second communication pipes to carry signals that generate said first and second electrostatic inductive fields across the fuel stream and the signals applied to said conductive coils so as to cause the generation of said electrostatic inductive fields having a frequency between 30 and 130 Hz, a voltage of between 0.05 and 1.5 V a current between 250 μA and 3.0 mA.

19. The method of purifying fuel of claim 14, wherein fuel is pumped from the fuel tank to the vehicle engine through first and second serially arranged fuel communication pipes, first and second pairs of opposed conductive plates are respectively disposed around said first and second communication pipes to carry signals that generate said first and second electrostatic inductive fields across the fuel stream and the signals applied to said conductive plates so as to cause the generation of said electrostatic inductive fields having a frequency between 30 and 130 Hz, a voltage of between 1 and 3 V a current between 800 μA and 3.0 mA.

20. The method of fuel purification of claim 14, wherein a first fuel pump is used to pump the fuel stream through said first electrostatic conductive fuel, said fuel filter and said second electrostatic conductive field and a second fuel pump is used to pump fuel into the engine after said second electrostatic conductive field is applied to the fuel stream.

* * * * *